US005367603A

United States Patent [19]

Wenrich et al.

[11] Patent Number: 5,367,603

[45] Date of Patent: Nov. 22, 1994

[54] SMOKE GENERATOR FOR FIREFIGHTING TRAINERS UTILIZING A METERING VENTURI

[75] Inventors: William R. Wenrich, Morris Plains; James J. Ernst, Livingston, both of N.J.

[73] Assignee: Symtron Systems, Inc., Fair Lawn, N.J.

[21] Appl. No.: 46,978

[22] Filed: Apr. 13, 1993

Related U.S. Application Data

[63] Continuation-in-part of Ser. No. 661,828, Feb. 27, 1991, abandoned.

[51] Int. Cl.[5] ..... F22B 1/28

[52] U.S. Cl. ..... 392/394; 392/403

[58] Field of Search ..... 392/394, 395, 402–406; 239/133, 135–138; 252/302, 305

[56] References Cited

U.S. PATENT DOCUMENTS

| | | | |
|---|---|---|---|
| 1,587,736 | 6/1926 | Schenk | 239/139 X |
| 1,990,165 | 2/1935 | Breuer | 252/305 X |
| 1,993,316 | 3/1935 | Blackwood et al. | 252/305 X |
| 2,070,038 | 2/1937 | Batt | 239/135 X |
| 2,249,191 | 7/1941 | Timberlake | 239/135 |
| 2,662,332 | 12/1953 | McIntire | 392/399 X |
| 2,850,615 | 9/1958 | Luse et al. | 252/305 X |
| 3,141,615 | 7/1964 | Waldron | 43/129 |
| 3,191,718 | 6/1965 | Haywood | 392/489 X |
| 3,242,098 | 3/1966 | Andrews | 43/129 X |
| 3,382,603 | 5/1968 | Oberto | 43/129 |
| 3,702,306 | 11/1972 | Waldron | 252/305 |
| 3,844,674 | 10/1974 | Moriyama | 417/352 X |
| 3,917,168 | 11/1975 | Tenney | 239/138 X |
| 4,114,022 | 9/1978 | Braulke | 239/136 X |
| 4,568,820 | 2/1986 | Swiatosz | 392/397 |

FOREIGN PATENT DOCUMENTS

| | | | |
|---|---|---|---|
| 641739 | 8/1950 | United Kingdom | 239/135 |

*Primary Examiner*—Teresa J. Walberg
*Attorney, Agent, or Firm*—Richard T. Laughlin

[57] ABSTRACT

A smoke generator wherein vaporative properties of a liquid smoke agent are activated by a heated air flow through a venturi with the vacuum created in the metering venturi controlling the flow of smoke producing liquid to the heated air. The smoke generator includes an air compressor, a heater, a metering venturi, a side venturi pipe, a smoke fluid reservoir, and a support.

9 Claims, 1 Drawing Sheet

SMOKE GENERATOR FOR FIREFIGHTING TRAILERS UTILIZING A METERING VENTURI

This application is a continuation in part of U.S. patent application Ser. No. 661,828 filed Feb. 27, 1991 now abandoned.

The invention generally relates to a smoke generator for use in fire fighting trainers, and in particular, the invention relates to a simple and effective smoke generator utilizing a metering venturi.

BACKGROUND OF THE INVENTION

The prior art smoke generator is described generally in U.S. Pat. No. 4,818,843, issued Apr. 4, 1989. Related patents include U.S. Pat. Nos.
4,764,660, issued Aug. 16, 1988,
2,070,038, issued Feb. 9, 1937
4,318,397, issued Mar. 9, 1982 and
4,114,022, issued Sep. 12, 1978.

The prior art smoke generator generally include a support housing, a liquid reservoir under pressure having a reservoir outlet pipe with a spray nozzle, a liquid pump connecting to the reservoir outlet pipe and having a pump outlet pipe, a coil heater connecting to the pump outlet pipe and having a heater outlet pipe extending to the exterior of the housing.

The U.S. Pat. No. 2,070,038 is directed to an apparatus for producing smoke which stays close to the ground. This is done by cooling the smoke with ice as the smoke leaves the conventional smoke generating apparatus. In the apparatus, the smoke making liquid is feed under pressure into the an air flow by means of a spray nozzle and a constricted pipe arrangement or venturi, is used to produce turbulence in the air flow. The pressure is necessary otherwise the smoke producing liquid can not pass through the spray nozzle. The use of spray nozzles have distinct disadvantages in that the nozzle tends to clog up and make continuous operation and maintenance very difficult. Further, because the smoke generating liquid is being supplied under pressure it is difficult to control the ratio of smoke generating liquid to air as the pressure is necessary to produce the spray. Still further, standard spray nozzles produce droplets that are too large for efficient, dry smoke production. Efficient spray nozzles require compressed air sources which introduce excessive cooling.

SUMMARY OF THE INVENTION

According to the present invention, a smoke generator is provided utilizing a metering venturi without having the smoke producing liquid under pressure. The arrangement of the invention allows greater control over the mixture of air and smoke producing liquid allowing the producing of a range of smoke conditions and permits slow movement of smoke at discharge to simulate the type of fire regularly encountered by fire fighters. It is also simple in its construction allowing long periods of operation without any maintenance.

This smoke generator comprises a support means, an unpressured storage tank for smoke producing liquid, a conduit pipe from the storage tank to a metering venturi located below the tank to allow feed of the smoke generating liquid to an inlet located at the restricted portion of the metering venturi. An air compressor supplies the air to the metering venturi. It is a feature of the invention that the air is relatively slow moving and heated before it passes through the metering venturi thereby promoting the mixing of the air with the smoke producing liquid. This permits the immediate vaporization of the smoke producing liquid and the admixing of the vapor with the air. A control valve is inserted in the conduit from the smoke producing liquid storage tank to meter the flow of the liquid to the metering venturi. The heating of the air is done through any conventional heater having a control allowing the selection of the heat required for best operation of the system.

By locating the venturi side inlet in the vacuum area of the metering venturi, the air flow effects the rate that the smoke generating liquid flows into the metering venturi and become admixed with the air passing through the metering venturi. The turbulence caused by the air flowing out of the restricted area of the metering venturi causes the admixing of the air with the smoke forming liquid as a vapor. The smoke forming liquid contacting the heated air volatilizes to form the smoke. Applicant does not need pressure feed for the smoke forming liquid since the feed is by gravity into the restricted area of the metering venturi and is aided by the flow of air through the restricted area of the metering venturi.

The foregoing and other objects, features and advantages of the invention will be apparent from the following description of the preferred embodiment of the invention as illustrated in the accompanying drawing.

DESCRIPTION OF THE PREFERRED EMBODIMENT

Figure 1:
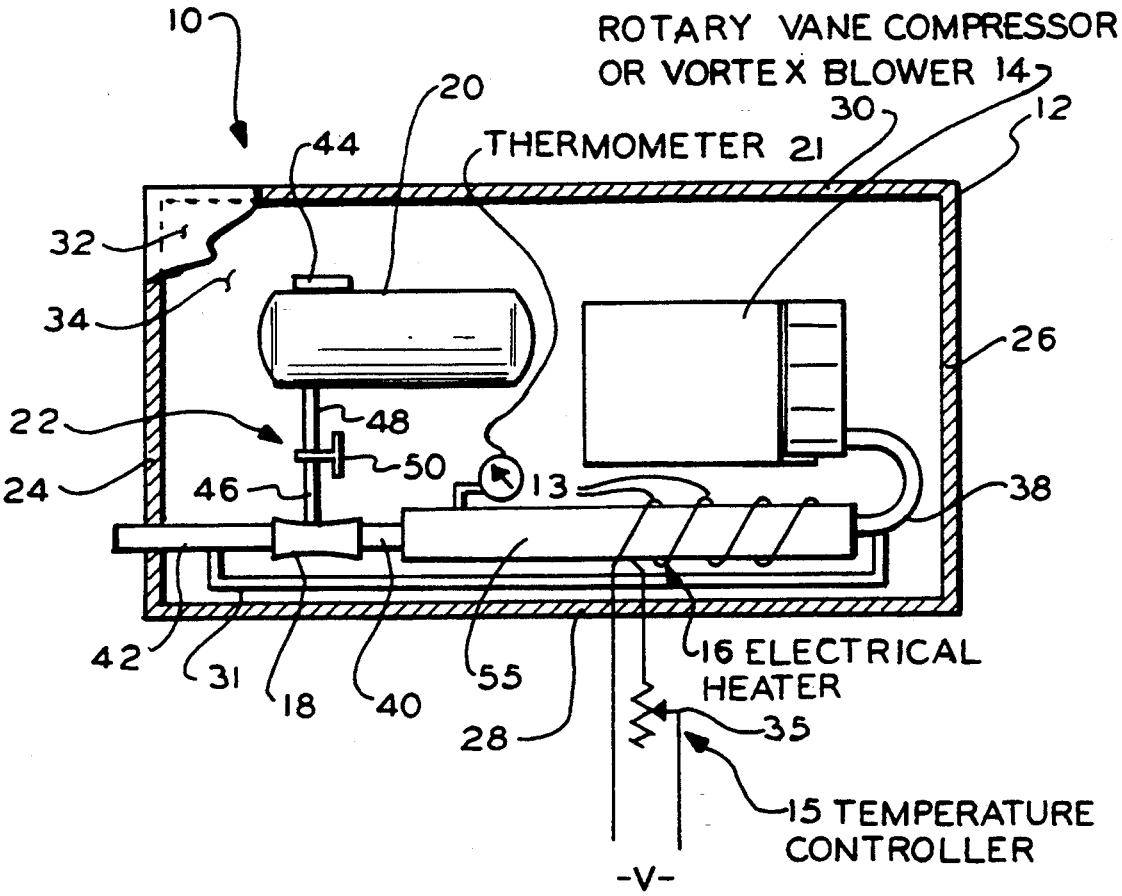
FIG. 1 is an elevation view of a smoke generator according to the present invention.
Figure 2:
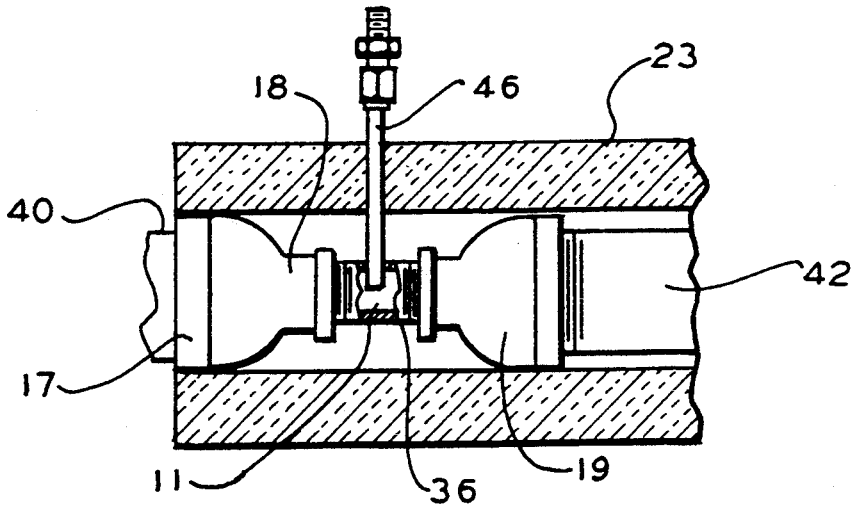
FIG. 2 is a side elevation partly in section showing the metering venturi and inlet for the smoke forming liquid.

As shown in FIGS. 1 and 2, a smoke generator generally indicated at 10, is provided. The smoke generator has a housing 12, a metering venturi 18, an air compressor 14 which feeds air to the metering venturi, a heater 16 for heating the air prior to passage to the venturi meter, a temperature controller generally indicated at 15 for controlling the temperature of the heated air, a reservoir 20 open to the atmosphere for containing smoke generating liquid and located above the metering venturi to allow flow of the smoke forming liquid by gravity. A control valve generally indicated at 22 for regulating the flow of the smoke forming liquid and a side tube or conduit 46 connected to the metering venturi in the area of vacuum for feeding the smoke forming liquid into the metering venturi. It is essential to the invention that the smoke forming liquid be feed by gravity into the restricted are of the metering venturi. By this method the smoke forming liquid mixes completely with the air without forming liquid droplets of smoke forming liquid.

Housing 12 has left and right end walls 24, 26, and bottom and top walls 28, 30, and front and rear walls 32, 34. Rear wall 34 supports air compressor 14, heater 16, temperature controller 15, venturi 18, and reservoir 20.

Air compressor 14 can be any type of compressor to supply low pressure air such as a rotary vane type or a vortex blower, with the vortex blower being preferred operating at approximately 20 in. water column or 0.6 psi. Air compressor 14 connects to a "U" shaped outlet pipe 38, which then passes into the heater 16. The air compressor is equipped with an auxiliary pipe 31 which feeds air directly to the outlet 42 of the smoke generator to provide addition air flow to the smoke cloud created.

The heater 16 can be any type of air heater. A typical type of heater is an electric resistance wire with a heat controller generally indicated at 15. The heater shown in FIG. 1 is typical of such heaters and is resistance wire 13 around a cylinder 55 carrying the air connected to a power source V through a rheostat as illustrated in FIG. 1. Electrical current is feed into the resistance wire and the amount of electrical current is controlled by a handle 35 on the rheostat which changes the amount of current being fed to the resistent wire 13. The heater generally has a temperature of about 1000° to 1200° F. to produce the desired air temperature. The air is usually heated to about 750° to 900° F. Temperature controller 15 can also be a digital type of controller. Heater 16 has an outlet pipe 40, which connects to metering venturi 18. A thermometer 21 can be provided for measuring the temperature of the air as it leaves the heater.

Metering venturi 18 is better illustrated in FIG. 2. It is formed of two pipe reducers 17 and 19 such as a reduction from a 1.25 inch to a 0.5 inch nipple 36 about 2 inches in length. In the drawing the nipple is shown with a broken away area 11 to show the positioning of inlet pipe 46 in the nipple. In FIG. 2 the metering venturi and piping is shown wrapped in insulation 23 to conserve the heat. The outlet pipe 42 extends through left wall 24.

Reservoir tank 20 has a vented cap 44 allowing the reservoir at all times to be under atmospheric pressure. Shut-off control valve generally indicated at 22, can be a conventional type of shut-off valve such as a stopcock 50 or an in-line needle valve, and has bottom and top pipes or conduits 46, 48. Pipe 46 connects to the metering venturi 18. Pipe 48 connects to supply reservoir 20.

Since the smoke generating liquid is being fed directly into the restricted area of the metering venturi 18 it allows admixing of the smoke fluid with the heated air. The heated air is delivered to metering venturi 18 from the flow of air which passed through the electric resistance heater 16. The temperature of the electric heater is controlled by the temperature controller 15. Air flow rate is dependent upon the temperature of the electric heater 16, in order to optimize temperature and mixing ratio for the type of smoke fluid being used. The arrangement of the invention prevents the formation of wet smoke which leaves an oil film on anything it contacts.

A by-pass pipe or conduit 31 can be present to conduct part of the air flow into the smoke discharge line to aid in the condensing of the smoke vapor to improve smoke density. An additional metering venturi (not shown) can be installed in the discharge line serving as an expansion chamber to enhance the vaporization of the smoke producing liquid.

The advantages of smoke generator 10 are indicated hereafter.

A) Smoke generator 10 is more simple in construction and less costly to build than the prior art smoke generator.

B) Smoke generator 10 avoids the need for a liquid pump, and other parts, of the prior art smoke generator.

C) Allowing the restricted area in the metering venturi to control the admixing of the smoke forming liquid allows clean, non-fouling operation.

D) Vaporization of smoke fluid inside a resistive tubing heater in the prior art smoke generator is avoided.

E) Frequency of repair of smoke generator 10 is minimized.

While the invention has been described in its preferred embodiment, it is to be understood that the words which have been used are words of description rather than limitation and that changes may be made within the purview of the appended claims without departing from the true scope and spirit of the invention in its broader aspects.

What is claimed is:

1. In a smoke generator apparatus for use in firefighting training having an air blower, an air heater for heating the air blown from the blower and a source of smoke producing liquid for admixing with the air, the improvement comprising:

an inline metering venturi having a restricted area of passage of air for creating a turbulence of the air passing through the metering venturi, the metering venturi having an inlet for the passage of air from the blower and an outlet for the passage of air admixed with the smoke producing liquid, a supply tank for the smoke producing liquid located above the metering venturi to allow gravitational flow of the smoke producing liquid from the tank to the restricted portion of the metering venturi, an inlet into the restricted portion of the metering venturi for passage of the smoke producing liquid to the restricted portion of the metering venturi to allow mixing of the smoke producing liquid with the air as it passes through the restricted area.

2. The apparatus of claim 1 wherein the flow of smoke producing liquid from the tank to the inlet to the restricted portion of the venturi is regulated by control means for regulating the ratio of air to smoke forming liquid.

3. The apparatus of claim 1 wherein the air blower is a rotary vane air compressor having an air compressor outlet for supplying compressed air in uniform volume.

4. The apparatus of claim 1 wherein the air blower is a vortex blower.

5. The apparatus of claim 1 wherein the heater is an electrical heater and includes means for temperature control.

6. An apparatus for generating smoke from a vaporizable liquid, comprising:

means for providing a supply of air flow;

means for providing a heat source for the air flow;

means for providing control for the temperature of the heat source;

means for providing a supply of vaporizable liquid;

means for providing proper mixing of said heated air flow and said vaporizable liquid comprising an inline metering venturi having a side venturi inlet on the venturi through which the smoke generating liquid is drawn into the venturi by vacuum; and means for adjusting air flow rate wherein said air flow is under positive pressure, and wherein said liquid is a smoke agent and wherein smoke output from the apparatus is controllable.

7. The apparatus as defined in claim 6 wherein the means for supplying an air flow is a rotary vane air compressor having an air compressor outlet for supplying compressed air in uniform volume.

8. The apparatus as defined in claim 6 wherein the means for supplying an air flow is a vortex blower.

9. A smoke generator apparatus comprising:

an inline metering venturi having a side venturi inlet for creating a turbulence in air passing inline through the venturi and further creating a vacuum in the venturi inlet;

an unpressurized liquid reservoir containing a smoke forming liquid;

a control valve having an inlet connected to the reservoir and having an outlet connecting to the venturi inlet for regulating the air to smoke forming liquid ratio;

means for supplying compressed air in uniform volume having an air outlet;

an electric air heater for heating the compressed air connected to the air outlet and having a heated air outlet connected to the venturi inlet;

a temperature controller means electrically connected to the electric heater to control the temperature of the air flowing through the electric air heater; and support means supporting the air compressor and the heater and the temperature controller and the venturi and the reservoir.

* * * * *